US008109502B2

(12) United States Patent
Mizuyama

(10) Patent No.: US 8,109,502 B2
(45) Date of Patent: Feb. 7, 2012

(54) MEDIA FEEDING DEVICE WITH OPEN/CLOSE MEMBER

(75) Inventor: Shogo Mizuyama, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 18 days.

(21) Appl. No.: 12/710,280

(22) Filed: Feb. 22, 2010

(65) Prior Publication Data

US 2010/0213659 A1 Aug. 26, 2010

(30) Foreign Application Priority Data

Feb. 24, 2009 (JP) ..... 2009-040320

(51) Int. Cl.
*B65H 1/08* (2006.01)

(52) U.S. Cl. ..... 271/126; 271/167; 271/121

(58) Field of Classification Search ..... 271/126, 271/127, 245, 167, 121
See application file for complete search history.

(56) References Cited

U.S. PATENT DOCUMENTS

| | | | | |
|---|---|---|---|---|
| 5,253,861 | A * | 10/1993 | Schmaling | 271/213 |
| 5,470,052 | A * | 11/1995 | Asakawa et al. | 271/118 |
| 5,655,762 | A * | 8/1997 | Yergenson | 271/121 |
| 5,725,208 | A * | 3/1998 | Miyauchi | 271/10.09 |
| 6,089,562 | A * | 7/2000 | Jang et al. | 271/10.11 |
| 6,089,563 | A | 7/2000 | Takashimizu et al. | |
| 6,832,723 | B2 | 12/2004 | Murata et al. | |
| 6,983,885 | B2 | 1/2006 | Endo et al. | |
| 7,025,347 | B2 * | 4/2006 | Masui et al. | 271/241 |
| 2005/0035531 | A1 | 2/2005 | Sasaki et al. | |
| 2008/0211163 | A1 | 9/2008 | Sasaki | |

FOREIGN PATENT DOCUMENTS

| | | | |
|---|---|---|---|
| JP | 60-067345 | A | 4/1985 |
| JP | 2002-087628 | A | 3/2002 |
| JP | 2004-206362 | A | 7/2004 |
| JP | 2009-018892 | A | 1/2009 |

* cited by examiner

*Primary Examiner* — Jeremy R Severson
(74) *Attorney, Agent, or Firm* — Kilpatrick Townsend & Stockton LLP

(57) ABSTRACT

An open/close mechanism of a media feed path for feeding a sheet medium from a media insertion unit allowing for a reduced parts count and minimal installation space is disclosed. In an embodiment, an open/close lever and paper pressure member of a check feeding device pivot horizontally on first and second vertical support shafts. When the pressure member pivots and presses against the delivery roller, the back end of the lever is pushed by the pressure member, pivoting the lever thereby retracting the front end of the lever from the check feed path. Because the lever is urged in a pivot direction causing the front end to enter the check feed path, when the paper pressure member returns to the position not pressed against the delivery roller, the open/close lever pivots in this urging direction returning to the position where the front end closes the check feed path.

5 Claims, 6 Drawing Sheets

MEDIA FEEDING DEVICE WITH OPEN/CLOSE MEMBER

This application claims priority to Japanese Patent Application No. 2009-040320, filed Feb. 24, 2009, the entirety of which is incorporated by reference herein.

BACKGROUND OF THE INVENTION

1. Field of Technology

The present invention relates to a media feeding device that is used in media processing devices such as check processing devices, printers, scanners, and magnetic reading devices to feed sheet media such as checks and recording paper one sheet at a time.

2. Description of Related Art

In banks and other financial institutions, checks, promissory notes, and other check-like negotiable instruments (collectively referred to as "checks" herein) submitted for payment or processing are loaded into a check processing device to capture an image of the front, read the magnetic ink character line, and sort the checks according to the reading result. As electronic processing of such instruments has become more common, the captured image data and magnetic ink character data is processed by computer, and the check information is managed by computer. A media feeding device that is used to feed sheet media to such check processing devices is taught in Japanese Unexamined Patent Appl. Pub. JP-A-2009-018892.

In the media feeding device taught in JP-A-2009-018892, the multiple checks inserted to a check insertion unit are delivered into a check feed path by a delivery roller, and a check separation mechanism disposed to the check feed path separates and sequentially feeds the delivered checks one by one to the check transportation path. When the checks are loaded into the check insertion unit, the path is blocked by the check separation mechanism so that the checks are not set in the check insertion unit deeply to the downstream side of the check separation mechanism. As a result, the timing at which the check is passed to the transportation roller on the transportation path side after passing the check separation mechanism is not too early and the checks are not fed at an inconsistent feed rate by the transportation roller before it reaches the constant speed of rotation.

A media separation mechanism is not needed in a media feeding device to which checks are inserted one at a time to the check insertion unit and are fed by the delivery roller into the transportation path. Because the check feed path between the check insertion unit and the check transportation path is therefore always open, there is a danger that a check may be inserted deeply to the check transportation path side when a check is inserted to the check insertion unit. To solve this problem, the check feed path can be blocked so that the checks can be loaded without entering deeply to the check transportation path side, and the check feed path can be opened when a check is fed.

However, the delivery roller and drive source therefor, and a pressure member for pressing the check to the delivery roller and a drive source therefor, are disposed to the check insertion unit and the check feed path. If a mechanism for opening and closing the check feed path is provided in addition to these parts, additional space must be provided to accommodate said mechanism, and the device size may therefore increase. The parts count also increases and device cost therefore increases.

SUMMARY OF THE INVENTION

A media feeding device according to the present invention enables rendering an opening and closing mechanism to the media delivery path for feeding sheet media from a media insertion unit using few parts and without requiring a large installation space, and by means of this opening and closing mechanism prevents passing the sheet medium to the transportation roller before the transportation roller reaches the specified constant speed.

A media feeding device according to a first aspect of the invention includes a media insertion unit to which a sheet medium is inserted; a media feed path to which the sheet medium is fed from the media insertion unit; a delivery roller that feeds the sheet medium from the media insertion unit toward the media feed path; a pressure member that can move between a pressure position pressing the sheet medium to the outside surface of the delivery roller, and a retracted position retracted from the outside surface; an open/close member that can move between a closed position intruding into the media feed path, and an open position retracted from the media feed path; and an urging member that urges the open/close member to the closed position side or the open position side. The pressure member moves the open/close member to the open position in resistance to the urging force of the urging member when moving from the retracted position to the pressure position, or moves the open/close member to the closed position in resistance to the urging force of the urging member when moving from the pressure position to the retracted position.

Because an open/close member that can open and close the media feed path is disposed in this aspect of the invention, when the open/close member is in the closed position, setting the sheet medium further to the inside of the media feed path from the media insertion unit can be prevented. The time until the sheet medium is passed to the transportation mechanism of the transportation path continuing downstream from the media feed path can therefore be prevented from becoming shorter than expected. In addition, because the open/close member that opens and closes the media feed path can be pushed and moved by the pressure member that presses the sheet medium to the delivery roller, a dedicated drive source for moving the open/close member does not need to be provided. The parts count can therefore be reduced and the device cost can be reduced.

Further preferably, this aspect of the invention also has a drive unit for moving the pressure member to the pressure position and the retracted position, and a detector that detects the sheet medium at the media insertion unit. The media feed path is a path for conveying the sheet medium through a media transportation path that passes a reading position for reading information recorded on the sheet medium. The drive unit stops driving when the pressure member is moved to the retracted position when the detector does not detect the sheet medium at the media insertion unit. When the detector detects the sheet medium at the media insertion unit, the drive unit starts driving the drive unit, moves the pressure mechanism to the pressure position, and starts transportation by the delivery roller at a timing when the sheet medium can be passed to the transportation mechanism of the media transportation path that starts driving based on detection of the sheet medium in the media insertion unit after the transportation speed of the transportation mechanism reaches a rated speed.

If transportation by the delivery roller can be started at a timing when the sheet medium is passed to the transportation mechanism after the transportation mechanism on the media transportation path has reached a condition in which it can convey the sheet medium at a constant speed, the sheet medium can be prevented from being passed to the transportation mechanism before it has reached a stable speed and transportation at an unstable speed can be prevented. Reading errors and a drop in reading accuracy by a reading device on the downstream side can therefore be suppressed.

In another aspect of the invention the media feed path has a pair of opposing walls disposed in opposition for guiding the sheet medium; the open/close member is an opening and closing lever that is supported so that one end thereof can pivot in a direction crossing the media feed path; the urging member is a spring member that urges the opening and closing lever in a first pivot direction causing said one end to enter the media feed path from an opening formed in one of the pair of opposing walls; and the pressure member pushes the other end of the opening and closing lever and causes the opening and closing lever to rotate opposite the first pivot direction when the pressure member moves to the pressure position.

Further preferably in this aspect of the invention, the pressure member is a lever member that pivots in the same pivot plane as the opening and closing lever; and as a result of the pivoting operation opposite the first pivot direction of the lever member, the distal end part of the lever member moves toward the delivery roller, and another part of the lever member pushes the other end of the opening and closing lever and causes the opening and closing lever to pivot opposite the first pivot direction.

By thus urging a pivotably disposed opening and closing lever in a specific pivot direction by means of a spring member, the opening and closing lever can be made to pivot in the pressure direction when the opening and closing lever is pressed by the pressure member, and when the pressure member retracts, the opening and closing lever can be returned to the original position by means of the urging force of the opening and closing lever. The opening and closing lever can therefore be moved in conjunction with movement of the pressure member.

Another aspect of the invention is media processing device having a reading device that reads information on a sheet medium at a reading position, and the media feeding device described herein.

Effect of the Invention

By having an open/close member that can open and close the media feed path, the invention can prevent setting the sheet medium further inside from the media feed path, and can prevent the time until the sheet medium is passed to the transportation mechanism of the transportation path continuing downstream from the media feed path from becoming shorter than expected. In addition, because the open/close member can be pushed and moved by the pressure member that presses the sheet medium to the delivery roller, a dedicated drive source for moving the open/close member does not need to be provided. The parts count can therefore be reduced and the device cost can be reduced.

Other objects and attainments together with a fuller understanding of the invention will become apparent and appreciated by referring to the following description and claims taken in conjunction with the accompanying drawings.

DESCRIPTION OF PREFERRED EMBODIMENTS

A preferred embodiment of a check processing device according to the present invention is described below with reference to the accompanying figures.

General Configuration

Figure 1:
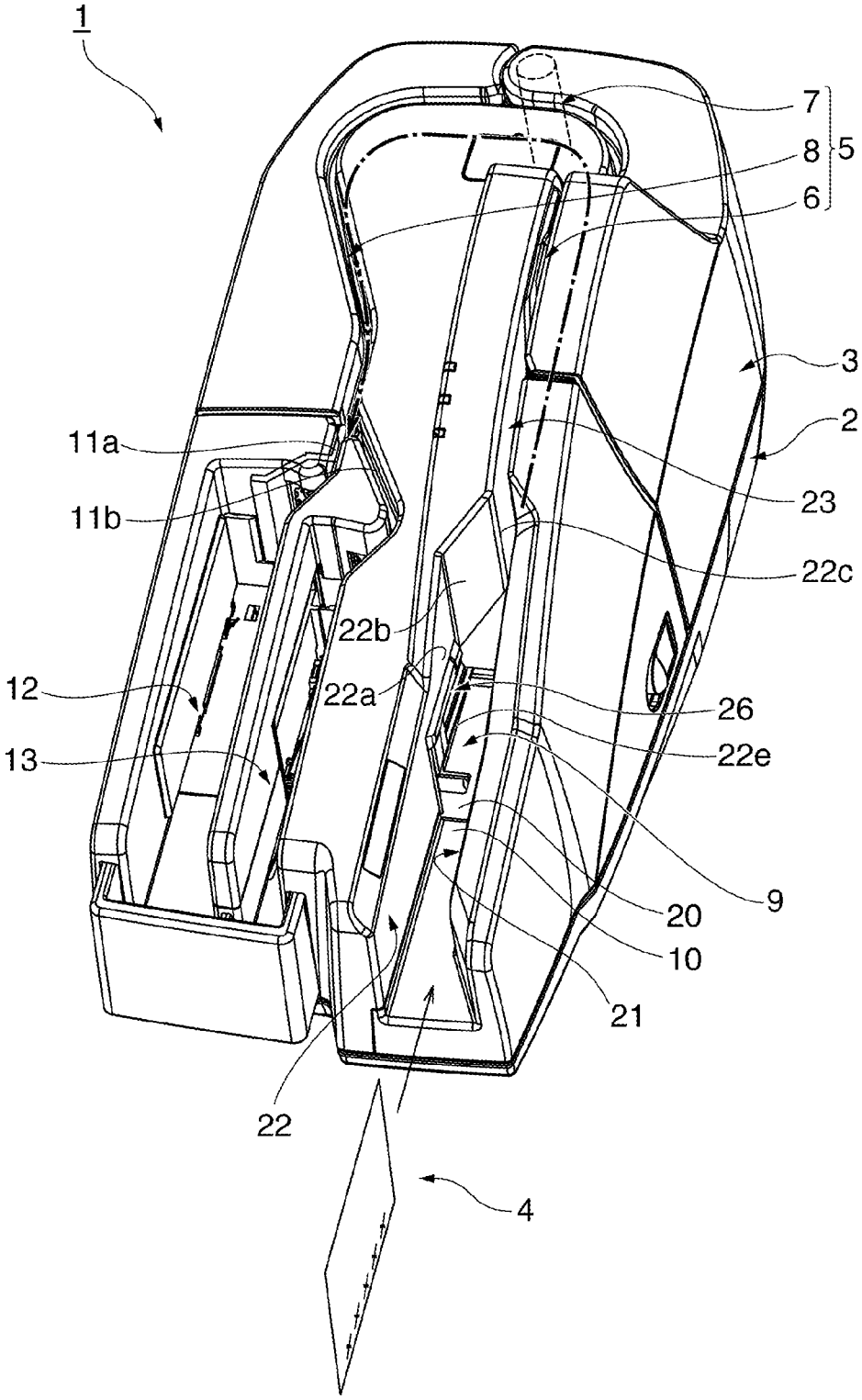
FIG. 1 is an oblique view of a check processing device according to the present invention.
Figure 2:
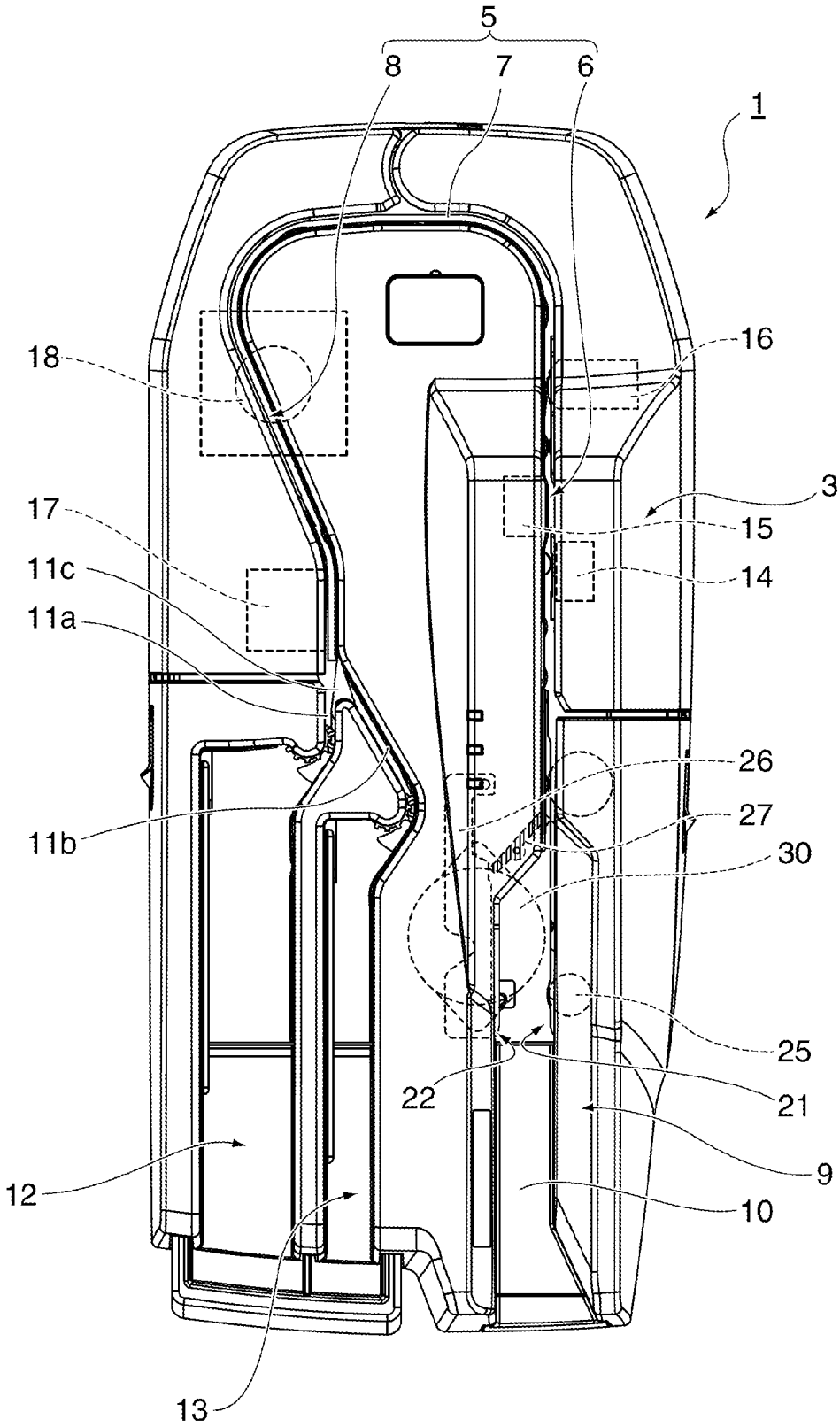
FIG. 2 is a plan view of the check processing device shown in FIG. 1.

FIG. 1 is an oblique view of a check processing device according to a preferred embodiment of the invention, and FIG. 2 is a plan view of the check processing device.

The check processing device 1 (media processing device) has a main case 2 and a cover case 3 covering the top thereof, and is configured with various other parts thereinside. A check 4 (sheet medium) transportation path 5 rendered by a narrow vertical channel is formed in the cover case 3. The transportation path 5 is generally U-shaped when seen from above, and includes a straight upstream-side transportation path portion 6, a curved transportation path portion 7 continuing from the upstream-side transportation path portion 6, and a slightly curving downstream-side transportation path portion 8 continuing from the curved transportation path portion 7.

A check feeding device 9 (media feeding device) is disposed on the upstream side of the upstream-side transportation path portion 6. The check feeding device 9 has a check insertion unit 10 that is a wide vertical pocket, and feeds the checks 4 inserted to the check insertion unit 10 one at a time to the upstream-side transportation path portion 6. The downstream end of the downstream-side transportation path portion 8 is connected to first and second check discharge units 12 and 13, which are wide vertical channels, through diversion paths 11*a* and 11*b* that branch left and right. A flapper 11*c* is disposed to the junction of the diversion paths 11*a* and 11*b*, and the checks 4 are sorted by switching the position of this flapper 11*c*. A sensor not shown for detecting insertion of a check 4 is disposed to the check insertion unit 10.

As shown in FIG. 2, a front scanner 14 as a front image reading means and a back scanner 15 as a back image reading means are disposed to the upstream-side transportation path portion 6. The magnetic head 16 for magnetic ink character reading is disposed on the downstream side of the back scanner 15. A printing mechanism 17 is disposed to the downstream-side transportation path portion 8. The printing mechanism 17 is a configuration that can be moved by a drive motor (not shown in the figure) between a printing position pressed to the check 4 and a retracted position removed from the printing position.

Various sensors for check transportation control are disposed to the transportation path 5. A paper length detector 111 for detecting the length of the fed check 4 is disposed to a position at the upstream side of the upstream-side transportation path portion 6. A multifeed detector for detecting check 4 multifeeding is disposed opposite the magnetic head 16.

A jam detector 113 is disposed at a position on the downstream side of the curved transportation path portion 7, and when a check 4 is detected for at least a specified time by the jam detector 113, a check is known to be jammed in the transportation path 5.

A print detector 114 for detecting the presence of a check 4 printed by the printing mechanism 17 is disposed at a position in the middle of the downstream-side transportation path portion 8. A discharge detector 115 for detecting checks discharged to the diversion paths 11*a* and 11*b* to the first and second check discharge units 12 and 13 is disposed at the junction therebetween.

Control System

Figure 3:
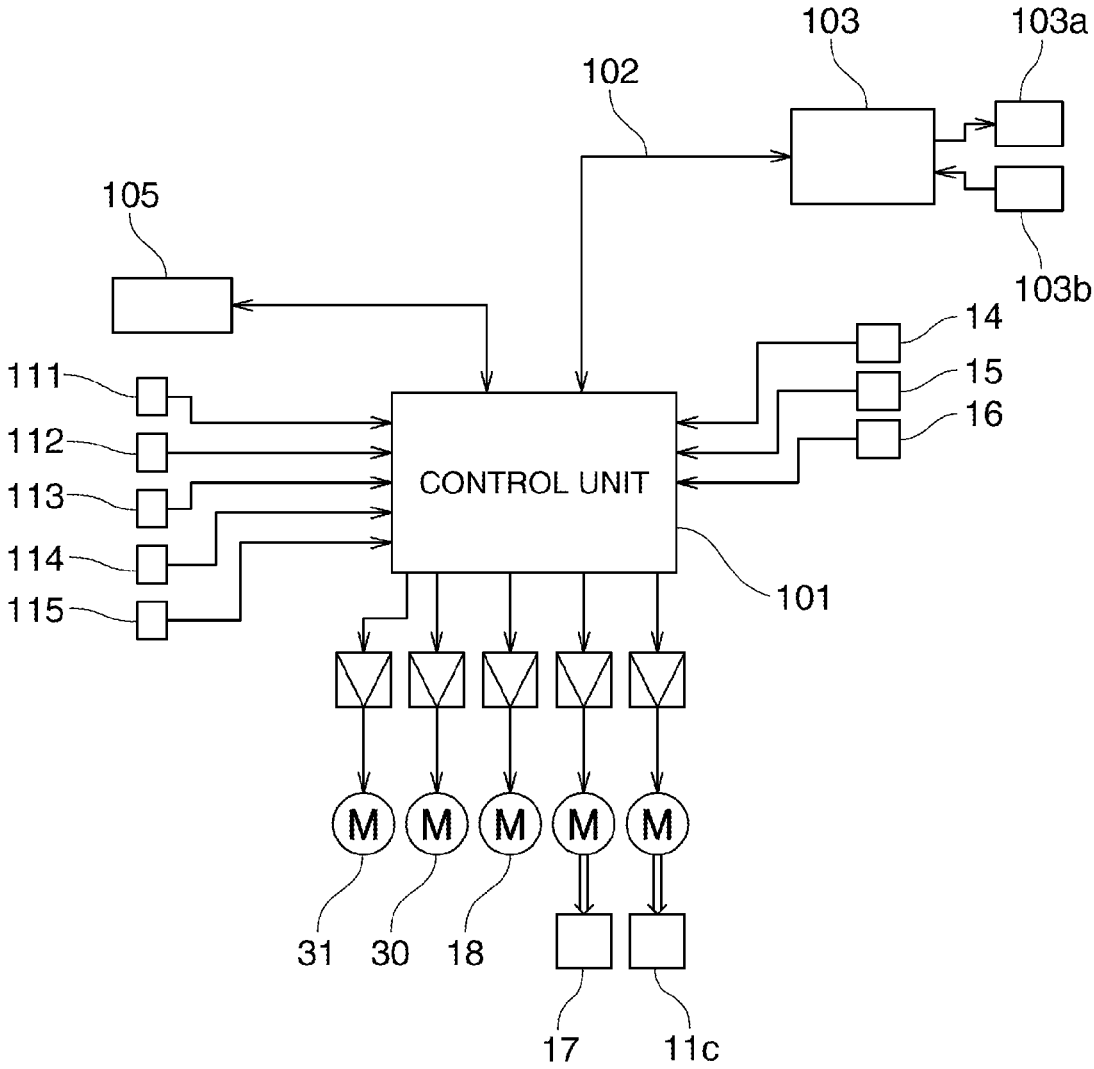
FIG. 3 is a schematic block diagram showing the control system of the check processing device in FIG. 1.

FIG. 3 is a schematic block diagram showing the control system of the check processing device 1. The control system of the check processing device 1 includes a control unit 101 having ROM and RAM and configured around a CPU. The control unit 101 is connected to a host computer system 103 through a communication cable 102.

The computer system 103 has input and output devices such as a display device 103*a*, and a operating unit 103*b* such as a keyboard and mouse. Commands such as for starting the check reading operation are input from the computer system 103 to the control unit 101.

When the control unit 101 receives a reading operation start command, the control unit 101 drives the transportation motor 18 to cause the transportation rollers (not shown in the figure) disposed to the transportation path 5 to turn while driving the drive motor 30 and drive motor 31 of the check feeding device 9 to feed the checks 4 one at a time from the check insertion unit 10 to the transportation path 5 and conveying the fed check 4 through the transportation path 5. The front image information, back image information, and magnetic ink character information of the check 4 read by the front scanner 14, the back scanner 15, and the magnetic head 16 are input to the control unit 101. This information is supplied to the computer system 103, image processing and character recognition processing operations are executed, whether the check was read correctly is determined, and the result of the decision is supplied to the control unit 101. Based on this result, the control unit 101 controls driving the printing mechanism 17 and flapper 11*c*.

The control unit 101 controls check 4 feeding and transportation through the transportation path 5 based on detection signals from the check detection sensor 112 disposed to the check insertion unit 10, and detection signals from the paper length detector 111, multifeed detector, jam detector 113, jam detector 113, and discharge detector 115 disposed to the transportation path 5. Note that an operating unit 105 including a power switch and operating switches rendered in the main case 2 is connected to the control unit 101.

Check Processing Operation

Figure 4:
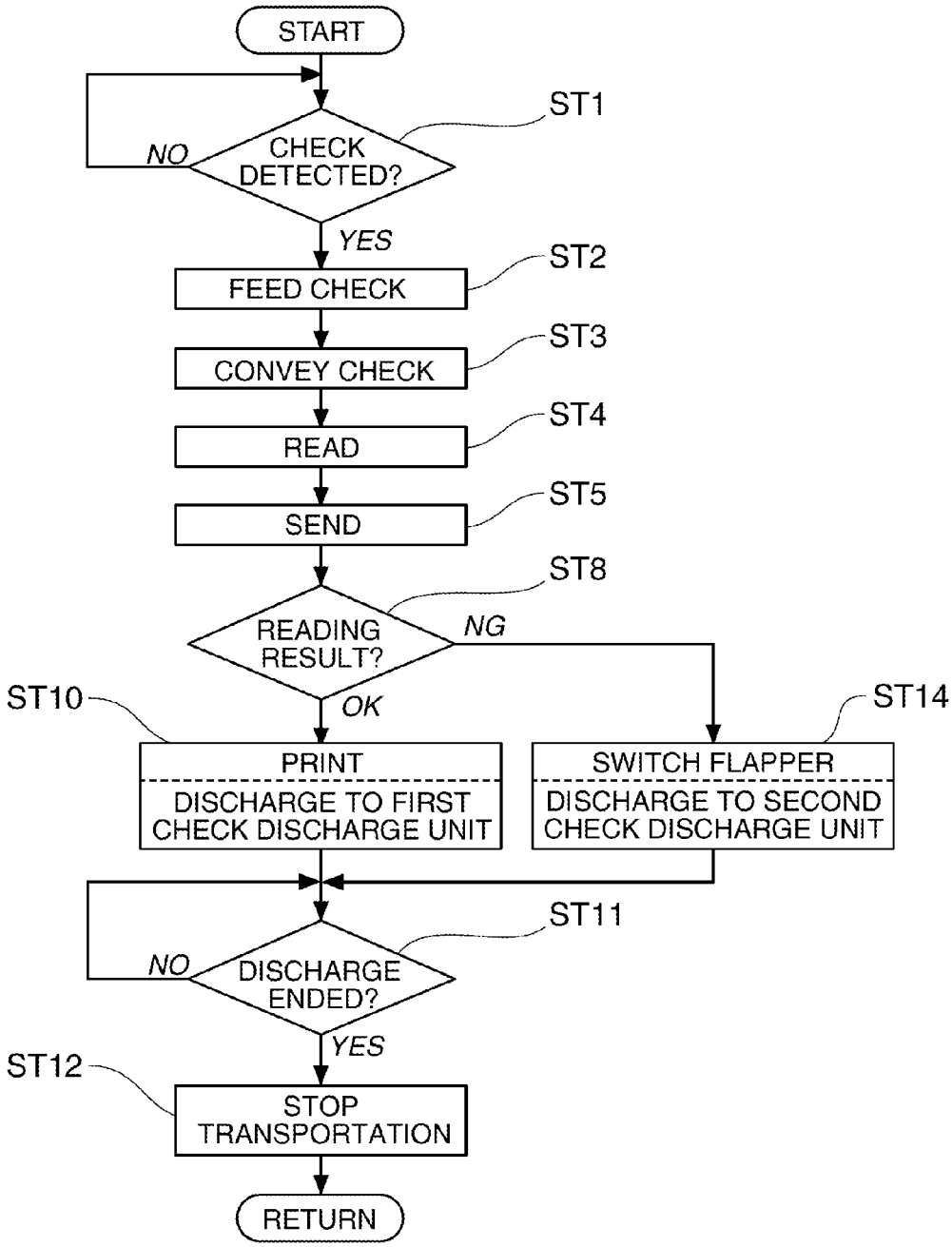
FIG. 4 is a flow chart describing the check processing operation of the check processing device shown in FIG. 1.

FIG. 4 is a flow chart describing the processing operation of the check processing device 1. When a start reading command is input as a result of the operator operating the operating unit 103*b* of the host computer system 103, or operating the operating unit 105, whether or not a check 4 was inserted is determined based on the check detection sensor 112 of the check insertion unit 10 (step ST1). If a check 4 was detected, the feed operation that delivers a check 4 from the check insertion unit 10 to the transportation path 5 is executed (step ST2). This check feeding operation is further described in detail below.

The fed check 4 is then conveyed through the transportation path 5 (step ST3). The front image, back image, and magnetic ink characters on the conveyed check 4 are read by the front scanner 14, the back scanner 15, and the magnetic head 16, respectively (step ST4).

The read information is sent through the communication cable 102 to the host computer system 103 (step ST5). The read front image, back image, and magnetic ink character information is processed on the computer system 103 side, and whether the check was read normally is determined.

A read error occurs if the check 4 is conveyed with the top and bottom upside down because the magnetic ink characters cannot be read. A read error also occurs if the check 4 is conveyed with the front and back reversed because the magnetic ink character information cannot be read. A read error may also occur if the check 4 is folded, torn, or skewed and a part of the magnetic ink characters cannot be read. A read error also occurs if specific information such as the check amount cannot be recognized from the front and back image data because the check 4 is creased, torn, or conveyed in a skewed position.

If it is determined that the check was read normally, the printing mechanism 17 is moved to the printing position (step ST8, ST10). The check 4 is printed with an endorsement, for example, by the printing mechanism 17 while being conveyed, discharged into the first discharge unit 12 by the flapper 11*c*, and the transportation operation then ends (step ST10, ST11, ST12).

However, if it is determined that a read error occurred or reading is not possible (step ST8), the flapper 11*c* is switched (step ST14). The printing mechanism 17 is held in the standby position, and does not print on the check 4. The check 4 is then diverted to the second discharge unit 13 by the flapper 11*c* and discharged thereinto, and the transportation operation then ends (step ST14, ST11, ST12).

Check Feeding Device

Figure 5A:
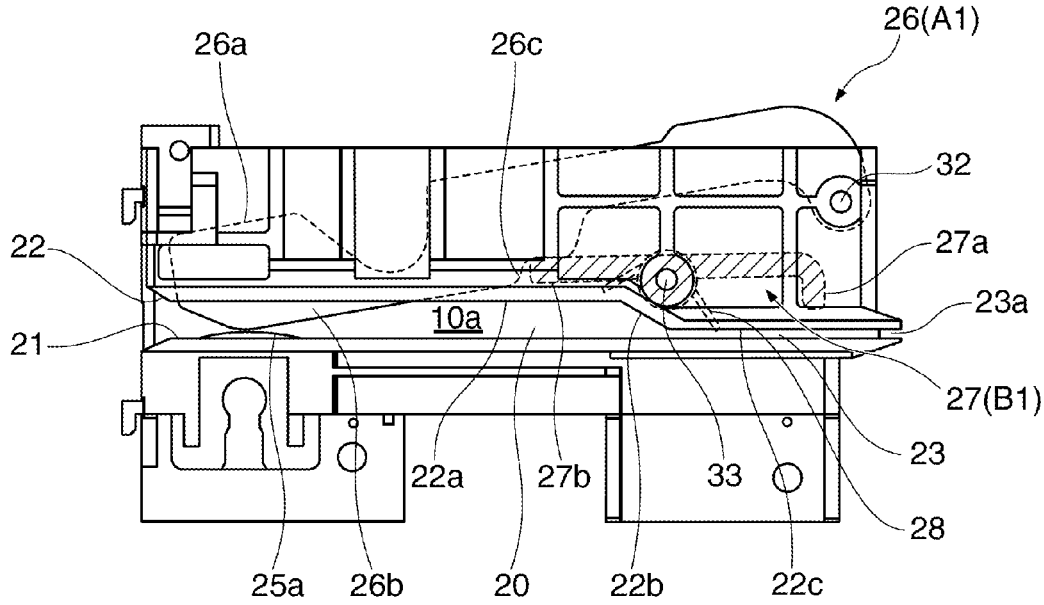
FIG. 5 schematically describes the configuration and operation of the check feeding device.
Figure 5B:
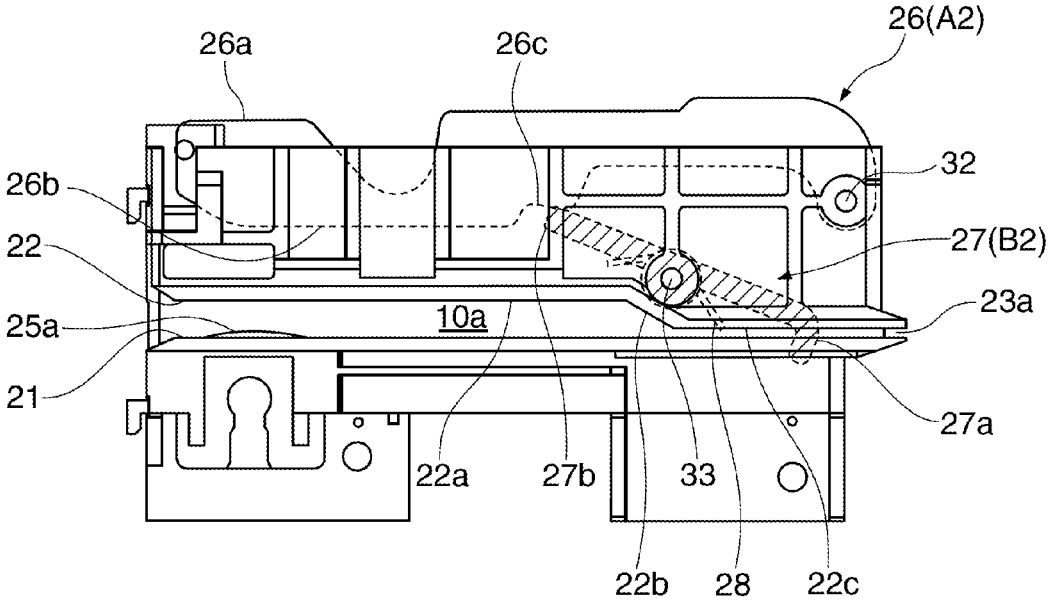

FIG. 5A and FIG. 5B describe the configuration and operation of the check feeding device 9.

The check insertion unit 10 (media insertion unit) of the check feeding device 9 is basically defined by a left and right pair of a first media guide surface 21 and second media guide surface 22, and a bottom 20.

The first media guide surface 21 is a straight, flat vertical surface.

The second media guide surface 22 includes a parallel guide surface part 22*a* disposed parallel to the first media guide surface 21 with a specific gap therebetween, an inclined guide surface part 22*b* that extends at an angle from the front end of the parallel guide surface part 22*a* to the first media guide surface 21 side, and a delivery-side parallel guide surface part 22*c* disposed from the end of the inclined guide surface part 22*b* opposite and parallel to the first media guide surface 21 with a narrow gap therebetween.

A wide check storage part 10*a* for inserting the checks 4 is defined by the parallel guide surface part 22*a* of the second media guide surface 22 and the first media guide surface 21 opposite thereto. The width of the part of the check storage part 10*a* at the downstream side in the transportation direction is gradually narrowed by the inclined guide surface part 22*b*, and is connected to a narrow check feed opening 23*a* of a constant width. The check feed opening 23*a* is defined by a delivery-side parallel guide surface part 22*c* (opposing wall) and the part of the first media guide surface 21 (opposing wall) opposite thereto. The end of this check feed path 23 is a check feed opening 23*a* connected to the transportation path 5.

As shown in FIG. 2 and FIG. 5, the check feeding device 9 has a delivery roller 25 for feeding the checks 4, a paper pressure member 26 (pressure member, lever member) for pressing the checks 4 to the delivery roller 25 side, and an open/close lever 27 (opening and closing member) for opening and closing the entrance from the check storage part 10*a* to the check feed path 23 in conjunction with operation of the paper pressure member 26. The open/close lever 27 is shaded in FIG. 2 and FIG. 5 so that the contour of the open/close lever 27 is more easily discernible. The check feeding device 9 also has a drive motor 30 for rotationally driving the delivery roller 25, and a drive motor 31 (see FIG. 3) for operating the paper pressure member 26 between the pressure position A1 and refracted position A2 further described below.

The delivery roller 25 is disposed along the first media guide surface 21, and the outside surface 25*a* thereof protrudes slightly from the first media guide surface 21 into the check storage part 10*a*. An opening 22*e* (see FIG. 1) is formed in the parallel guide surface part 22*a* of the second media guide surface 22 opposite the delivery roller 25.

The paper pressure member 26 is attached so that it can pivot horizontally on a first vertical support shaft 32 disposed beside the check feed opening 23*a* (the top side in FIG. 5). The paper pressure member 26 extends from the first vertical support shaft 32 to the entrance side of the check storage part 10*a* (the left side in FIG. 5), and a balloon part 26*b* that balloons out to the delivery roller 25 side (the bottom in FIG. 5) is formed on the end of the distal end part 26*a*. This balloon part 26*b* can move in and out of the check storage part 10*a* through the opening 22*e* in the second media guide surface 22 in conjunction with the pivoting action of the paper pressure member 26 on the first vertical support shaft 32.

The open/close lever 27 is attached so that it can pivot horizontally on a second vertical support shaft 33 disposed between the inclined guide surface part 22*b* and the paper pressure member 26. The open/close lever 27 is urged by the spring force of a torsion spring 28 (spring member) attached to the second vertical support shaft 33 in the pivoting direction (clockwise in FIG. 5) causing the front end part 27*a* extending to the check feed opening 23*a* side (the right in FIG. 5) to enter the check feed path 23. The back end part 27*b* of the open/close lever 27 is urged by this spring force to the paper pressure member 26 side, and is stopped at a position in contact with a recessed part 26*c* formed at a corner part of the balloon part 26*b* on the first vertical support shaft 32 side.

FIG. 5A shows the pressure position A1 of the paper pressure member 26 where the balloon part 26*b* protrudes into the check storage part 10*a*, and the open position B1 of the open/close lever 27 where the front end part 27*a* is retracted from the check feed path 23. At the pressure position A1 the balloon part 26*b* of the paper pressure member 26 protrudes to a position applying pressure to the outside surface 25*a* of the delivery roller 25 protruding from the first media guide surface 21 into the check storage part 10*a*. Because the recessed part 26*c* at the balloon part 26*b* is proximal to the check storage part 10*a* in this position, the back end part 27*b* of the open/close lever 27 being pushed by the recessed part 26*c* pivots to the check storage part 10*a* side against the spring force of the torsion spring 28, and the front end part 27*a* moves to the open position B1 retracted from the check feed path 23. More specifically, closing of the check feed path 23 by the front end part 27*a* of the open/close lever 27 is cancelled in the open position B1.

FIG. 5B shows the retracted position A2 of the paper pressure member 26 where the balloon part 26*b* is retracted from inside the check storage part 10*a*, and the closed position B2 of the open/close lever 27 where the front end part 27*a* closes the check feed path 23. The paper pressure member 26 is substantially parallel to the check storage part 10*a*, and the balloon part 26*b* and the recessed part 26*c* formed at the corner thereof are separated from the check storage part 10*a*, at the retracted position A2. In this position, the open/close lever 27 moves to the closed position B2 where the back end part 27*b* pivots to a position touching the recessed part 26*c* removed from the check storage part 10*a* by the spring force, and the front end part 27*a* is inserted to the check feed path 23. When in the closed position B2, the open/close lever 27 closes the check feed path 23 by means of the part curled into a hook shape at the distal end of the front end part 27*a*.

The check feeding device 9 according to this embodiment of the invention is configured premised on checks being inserted to the check insertion unit 10 and read one at a time, and a media separation mechanism such as provided in a device according to the related art is not provided. As a result, the open/close lever 27 is disposed so that the check feed path 23 can be closed to prevent a check 4 from being set deeply into the transportation path 5 side.

Check Feeding Operation

Figure 6:
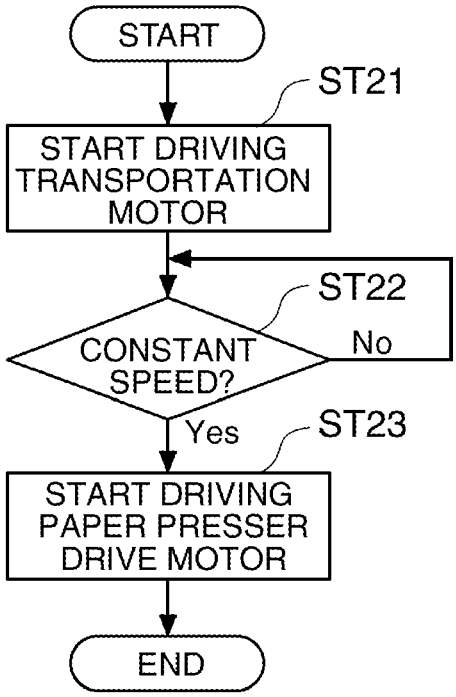
FIG. 6 is a flow chart of the check feeding process.

FIG. 6 is a flow chart of the check feeding process executed in step ST2 in the flow chart shown in FIG. 4.

When a check 4 is not detected in step ST1 in FIG. 4, the drive motor 30 is driven and stopped after the paper pressure member 26 is moved to the retracted position A2. Because the open/close lever 27 is stopped at the closed position B2 at this time, the entrance to the check feed path 23 is closed by the front end part 27*a* of the open/close lever 27. As a result, the distal end of a check 4 will not be set to a position deeper than the open/close lever 27.

When the check detection sensor 112 detects a check 4 inserted to the check insertion unit 10, the control unit 101 first starts driving the transportation motor 18 to cause the transportation rollers (not shown in the figure) disposed along the transportation path 5 to start turning (step ST21). The control unit 101 then determines if the speed of rotation of the transportation motor 18 has reached the rated speed (step ST22), and repeats this decision step until the speed of the transportation motor 18 reaches the rated speed. When it is determined that the rotational speed of the transportation motor 18 reached the rated speed, driving the drive motors 30 and 31 starts (step ST23).

In step ST23 the control unit 101 rotates the paper pressure member 26 to the pressure position A1 by rotationally driving the drive motor 31*a* specific amount. As a result, the check 4 is pressed to the delivery roller 25 side by the balloon part 26*b* of the paper pressure member 26. Because driving the drive motor 30 also starts at this time and the delivery roller 25 starts turning, the check 4 pressed to the delivery roller 25 is fed to the check feed path 23 side. Note that the timing when driving the drive motor 30 starts may be the timing when movement of the paper pressure member 26 to the pressure position A1 is completed, or a later time.

When feeding the check 4 by means of the delivery roller 25 starts, the open/close lever 27 that closes the entrance to the check feed path 23 by means of the front end part 27*a* has already moved completely to the open position B1 in conjunction with the rotation of the paper pressure member 26 to the pressure position A1. As a result, the check 4 advanced by the delivery roller 25 is not blocked by the open/close lever 27, and enters the transportation path 5 through the check feed path 23.

The check 4 fed into the transportation path 5 is passed to the transportation roller that is driven by the transportation motor 18, which has already reached the rated constant speed, and is rotating at the rated speed. The check 4 therefore passes the reading positions of the front scanner 14, back scanner 15, and magnetic head 16 at the rated speed.

Because a open/close lever 27 that closes the check feed path 23 is disposed in this embodiment of the invention, setting the check 4 deeply into the transportation path 5 side can be prevented. The leading end of the check 4 fed by the delivery roller 25 is therefore prevented from reaching the transportation rollers of the transportation path 5 sooner than expected, and the check 4 can be prevented from being gripped by the transportation rollers and conveyed before the transportation rollers reach the rated speed.

Furthermore, because this embodiment of the invention is configured so that the open/close lever 27 is driven to the open position B1 by the paper pressure member 26 that presses the check 4 to the delivery roller 25, and is returned to the closed position B2 by the spring force when the paper pressure member 26 returns to the retracted position A2, pressing the check 4 to the delivery roller 25 and opening and closing the entrance to the check feed path 23 can be linked using a single drive power source. A common drive source can therefore be used to operate two members, the parts count can be reduced, and device cost can be reduced.

In addition, when insertion of a check 4 is detected in this embodiment of the invention, driving the transportation motor 18 that is the drive source of the transportation rollers disposed at various positions along the transportation path 5 starts first, and driving the drive motors 30 and 31 of the check feeding device 9 starts after the rotational speed of the transportation motor 18 reaches a substantially constant speed. Therefore, the check 4 fed into the transportation path 5 can be passed to transportation rollers that have already reached the rated speed, and can be read consistently by the front scanner 14, back scanner 15, and magnetic head 16. The occurrence of read errors and a drop in reading precision can therefore be prevented.

Other Embodiments

The paper pressure member 26 of the check feeding device 9 is driven by a drive motor 31 that is separate from the drive motor 30 that rotationally drives the delivery roller 25, but a configuration in which the drive power of the drive motor 30 is transferred through a transmission mechanism to the paper pressure member 26, and the drive motor 30 is used as a common drive source for driving three members, that is, the delivery roller 25, the paper pressure member 26, and the open/close lever 27, is also conceivable.

Driving the drive motors 30 and 31 starts after a rotary encoder or other sensor detects that the rotational speed of the transportation motor 18 has reached the rated speed in the embodiment described above, but the rise time required for the stepping motor or other type of transportation motor 18 to reach the rated rotational speed may be stored, and driving the drive motors 30 and 31 may be started immediately after this rise time passes. A sensor for detecting the rotational speed of the transportation motor 18 does not need to be used with this configuration. In this configuration, the timing when driving the drive motors 30 and 31 starts can be set with consideration for the time required for a check 4 loaded into the check feeding device 9 to be advanced by the delivery roller 25 to the position where it is passed to the transportation rollers in the transportation path 5.

For example, this required time may be subtracted from the rise time of the transportation motor 18 and stored, and the driving the drive motors 30 and 31 may start immediately after this specified time passes after driving the transportation motor 18 starts. This enables increasing the check 4 processing speed as much as possible within the range where read errors or a drop in reading precision do not occur.

APPLICATION IN INDUSTRY

A media feeding device according to the invention can be used in the same way in other types of devices for processing sheet media other than check processing devices, including printers, scanners, and magnetic reading devices.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A media feeding device comprising:

a media insertion unit to which a sheet medium is inserted;

a media feed path to which the sheet medium is fed from the media insertion unit, wherein the media feed path has a pair of opposing walls disposed in opposition for guiding the sheet medium;

a delivery roller that feeds the sheet medium from the media insertion unit toward the media feed path;

a pressure member that can move between a pressure position pressing the sheet medium to the outside surface of the delivery roller, and a retracted position retracted from the outside surface;

an open/close member that can move between a closed position intruding into the media feed path, and an open position retracted from the media feed path, wherein the open/close member is an opening and closing lever that is supported so that one end thereof can pivot in a direction crossing the media feed path; and an urging member that urges the open/close member to the closed position side or the open position side, wherein the urging member is a spring member that urges the opening and closing lever in a first pivot direction causing said one end to enter the media feed path from an opening formed in one of the pair of opposing walls;

wherein the pressure member pushes the other end of the opening and closing lever and causes the opening and closing lever to rotate opposite the first pivot direction when the pressure member moves to the pressure position in resistance to the urging force of the urging member.

2. The media feeding device described in claim 1, further comprising:

a drive unit for moving the pressure member to the pressure position and the retracted position; and a detector that detects the sheet medium at the media insertion unit;

wherein the media feed path is a path for conveying the sheet medium through a media transportation path that passes a reading position for reading information recorded on the sheet medium, and the drive unit stops driving when the pressure member is moved to the retracted position when the detector does not detect the sheet medium at the media insertion unit, and when the detector detects the sheet medium at the media insertion unit, starts driving the drive unit, moves the pressure member to the pressure position, and starts transportation by the delivery roller at a timing when the sheet medium can be passed to a transportation mechanism of the media transportation path that starts driving based on detection of the sheet medium in the media insertion unit after the transportation speed of the transportation mechanism reaches a rated speed.

3. The media feeding device described in claim 2, wherein:

when the sheet medium is inserted to the media insertion unit, the drive unit starts driving after the drive speed of the drive source of the transportation mechanism reaches a substantially constant speed.

4. The media feeding device described in claim 1, wherein:

the pressure member is a lever member that pivots in the same pivot plane as the opening and closing lever; and as a result of the pivoting operation opposite the first pivot direction of the lever member, the distal end part of the lever member moves toward the delivery roller, and another part of the lever member pushes the other end of the opening and closing lever and causes the opening and closing lever to pivot opposite the first pivot direction.

5. A media processing device comprising:

a reading device that reads information on a sheet medium at a reading position; and the media feeding device described in claim 1.

* * * * *